United States Patent [19]

Hahmann

[11] 4,312,331

[45] Jan. 26, 1982

[54] REANIMATION TABLE FOR NEWBORN BABIES AND INFANTS

[75] Inventor: Günther Hahmann, Lübeck, Fed. Rep. of Germany

[73] Assignee: Drägerwerk Aktiengesellschaft, Fed. Rep. of Germany

[21] Appl. No.: 133,594

[22] Filed: Mar. 24, 1980

[30] Foreign Application Priority Data

Apr. 3, 1979 [DE] Fed. Rep. of Germany ..... 2913282

[51] Int. Cl.[3] ..... A61G 11/20

[52] U.S. Cl. ..... 128/1 B; 128/399

[58] Field of Search ..... 128/1 B, 205.26, 402, 128/399; 119/30, 37; 312/209, 236; 5/421; 126/204, 299 C

[56] References Cited

U.S. PATENT DOCUMENTS

| | | | |
|---|---|---|---|
| 3,529,590 | 9/1970 | Grosholz | 128/1 B |
| 3,782,362 | 1/1974 | Puzio | 128/1 B |
| 3,858,570 | 1/1975 | Beld et al. | 128/1 B |

*Primary Examiner*—Henry J. Recla
*Attorney, Agent, or Firm*—McGlew and Tuttle

[57] ABSTRACT

A reanimation table for newborn infants comprises a base member having a top lying surface for receiving the infant and a block shape base member at one end of the lying surface. The block shape base member forms a support for pivotally supporting an outer support wall which may be made in one or two separately pivotal upright side surface forming members which are pivotally mounted adjacent each end of the block member. Support wall surfaces may be positioned in a horizontal position overlying the lying surface to confine the infant therein and provide a guide surface for it or the support surface or any portion thereof may be pivoted to an upright position extending out of the way of the lying surface for the infant. The construction also includes a U-shaped support yoke for mounting an electric radiation heater on a top cross leg or support web of the yoke in a position such that the heater extends outwardly over the lying surface. The protective wall provides an outer protection around the support yoke when the wall is in an upright position and it is sized so that it may be pivoted downwardly to the horizontal position without interfering with the operation of the heater.

6 Claims, 2 Drawing Figures

REANIMATION TABLE FOR NEWBORN BABIES AND INFANTS

FIELD AND BACKGROUND OF THE INVENTION

This invention relates in general to devices for supporting newborn infants and in particular to a new and useful reanimation table for newborn babies and infants.

An optimum delivery arrangement for newborn babies includes the equipment of the labor room with a reanimation place. This reanimation place should permit in an optimum manner among other things: heat care, reanimation, oxygen or aerosol therapy or intensive care.

A known incubator of a nursing apparatus for newborn babies is mounted on a casing which also contains cooling and heating means. The heating means go into action at an ambient temperature which is below the blood temperature. The incubator itself consists of a trough-shaped bottom with a mattress support. Four trapezoidal boards form the side or end walls of the incubator. The rear board is secured on the edge of the bottom. It forms with the vertical an angle of 40° upward and downward. The two lateral boards are secured by hinges on the lateral edges of the bottom. In a closed position, they also form an angle of about 40° upward and inward. The fourth front board is articulated to the front edge of the bottom; it forms the same angle. With the exception of the rear board, all boards can be hinged down, they then lie flat on the top side of the casing.

Though it is possible to get to the child by folding down the boards, the folded-down boards are in the way, and they are particularly subject to contamination. The arrangement of the heater on the boards prevents heat care with the boards folded down.

SUMMARY OF THE INVENTION

The invention provides a reanimation table for newborn babies and infants whose protective wall can be removed rapidly with one hand so that operations are not hindered, and it can be closed again in a simple manner.

The entire protective wall bounding the lying surface is removed in a simple manner with manipulation. To this end it is opened up so that it is not in the way in the working range. Accessories for the treatment of the infants can be mounted directly on the lying surface. The protective wall can be closed again in an equally simple manner.

The same advantages are obtained if the protective wall is divided into two symmetrical parts which are pivotally supported in bearings. If necessary, it is possible to remove only one half of the protective wall. This additional advantage is offered by this additional advantageous idea.

Accordingly, it is an object of the invention to provide a reanimation table for newborn infants which comprises a member having a top surface defining a lying surface for receiving the infant with a base member mounted adjacent one end of the lying surface and providing a support for a yoke of substantially U-shaped form which carries an electric radiation heater at its upper end so that it may extend outwardly over the lying surface and further including a protective wall which is pivoted at the base member so that the whole or a portion thereof may be selectively positioned in a horizontal position so that its side walls are upright around the lying surface to protect the infant therein or it may be moved out of the way of the lying surface to an upright position overlying and protecting the yoke.

A further object of the invention is to provide a construction wherein a lying surface for newborn infants has a yoke member for supporting a radiation heater thereover and including a protective wall which is pivotally mounted outside of the yoke for the heater and may be positioned either in a horizontal position of which its side walls are upright around the lying surface or in an upright position.

A further object of the invention is to provide a device for holding infants during the early hours after birth which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
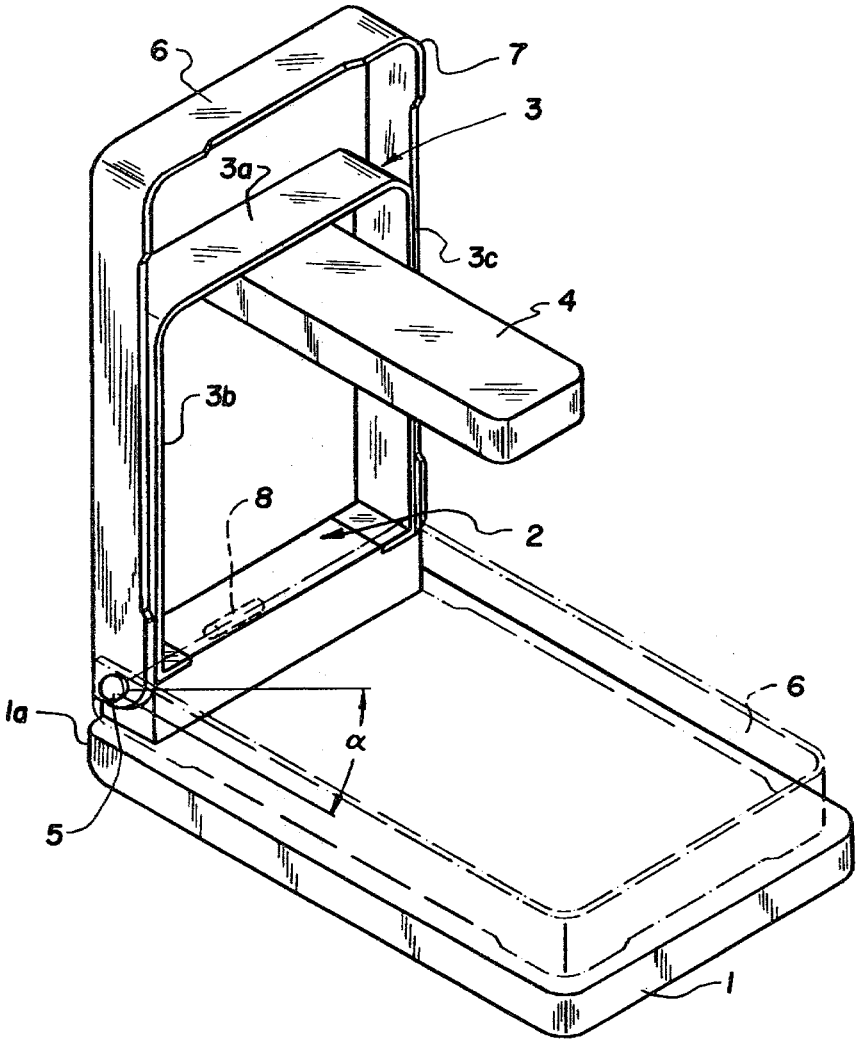
FIG. 1 is a front top perspective view of a reanimation table constructed in accordance with the invention.

Referring to the drawings in particular, the invention embodied therein comprises a reanimation table for receiving newborn infants which includes a receiving member 1 defining a substantially planar top lying surface for receiving a newborn infant thereon. A base member 2 is mounted on the lying surface adjacent one end or particularly the rear edge 1*a* of the receiving member 1. The base member 2 provides a support for a heater support yoke 3 and a protective wall member or assembly generally designated 6. The heater support yoke 3 includes a top web portion 3*a* which supports a heater 4 in a position such that it extends over the lying surface 1*a* and may radiate heat downwardly therefrom. The protective wall 6 is mounted for pivotal movement on pivots 5 adjacent each end of the block member 2 so that it may be shifted between a solid line vertical position to a substantially horizontal position and with its side walls upright and forming an encircling protective shield along with the base member for an infant on the lying surface 1*a*.

A lying surface 1 of a reanimation table has a rear end face 1*a* which is flush with a base member 2 over which a U-shaped downwardly opening yoke 3 is mounted. An electric radiation heater 4 is secured to a top web 3*a* of the yoke 3. Radiation heater 4 radiates downwardly to lying surface 1. On base 2 is pivotally mounted U-shaped protective wall 6 which is pivoted in bearings 5. Protective wall 6 is a U-shaped part made of transparent plastic corresponding to the long side walls 3*b* and 3*c* of the yoke 3 and the base member 2 above the lying surface 1. The protective wall 6 can be swivelled between the positions shown in solid lines in FIGS. 1 and 2 and the positions indicated by broken lines in these same figures. In the open solid line position, shown in the drawing, the protective wall is out of engagement with the lying surface 1 and the lying surface 1 is freely accessible to the infant. In the position denoted by the dotted lines, the protective wall 6 extends in a substantially horizontal position in engagement with the lying surface.

Bearing 5 in the base 2 contains a self-locking brake 8, e.g., a pneumatic piston acting to move or to bias wall 6 to a vertical position starting from angle alpha, so as to prevent a dangerous collapse of the protective wall 6, so that closing to a horizontal position is always intentional. Protective wall 6 can be locked at a selected position in the range above angle alpha.

Protective wall 6 has support legs or projections at the two free corners and the corners under bearing 5. These legs 7 keep the remaining edge of protective wall 6 away from lying surface 1. This prevents pinching of protruding extremities of the infant.

Figure 2:
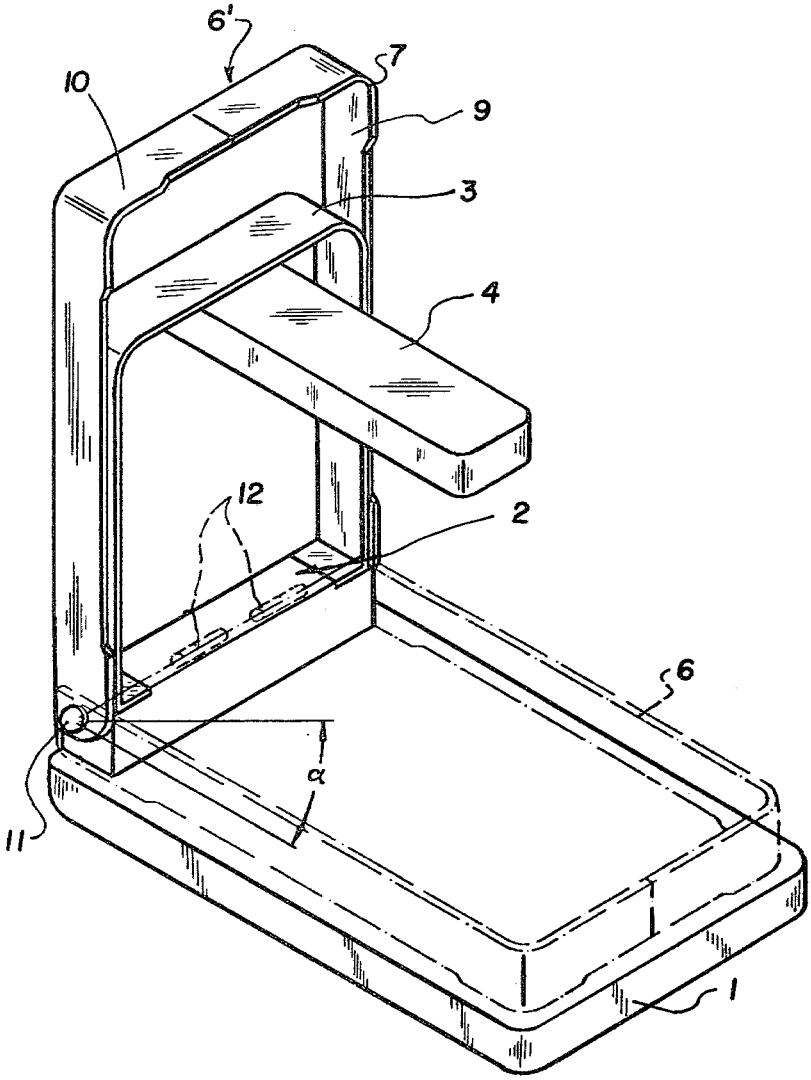
FIG. 2 is a view similar to FIG. 1 of another embodiment of the invention.

The protective wall 6' of the embodiment in FIG. 2 has U-shaped symmetrical side parts 9 and 10 secured in bearings 11. These parts 9 and 10 can be swivelled independent of each other. It is thus possible to make only the required part of lying surface 1 accessible. Parts 9 and 10 are held by brakes 12 in the end positions or at any selected angle.

While specific embodiments of the invention have been shown and described in detail to illustrate the application of the principles of the invention, it will be understood that the invention may be embodied otherwise without departing from such principles.

What is claimed is:

1. A reanimation table for a newborn infant comprising a receiving member having a top surface defining a substantially planar lying surface for receiving the infant, a base member mounted on said lying surface adjacent one end of said receiving member, a yoke member mounted on said base member and extending vertically upwardly therefrom, a radiation heater connected to said yoke member and extending outwardly over said lying surface, and a protective wall pivotally mounted to said base member, said protective wall comprising a single U-shaped part having leg portions on each side pivotally mounted adjacent each end of said base member and a web interconnecting said leg portions, said protective wall being pivotal between a first substantially horizontal position in engagement with said lying surface in which said leg portions and web extend upright to form with said base member an enclosure for the infant over said lying surface and a second position in which said protective wall may extend substantially upright out of engagement with said lying surface.

2. A reanimation table according to claim 1, wherein said protective wall includes wall portions having projections which engage on the lying surface and support the remaining portion of said wall above said lying surface.

3. A reanimation table according to claim 1, wherein said base member comprises a block shaped member.

4. A reanimation table according to claim 3, wherein said block member is located adjacent an edge of said lying surface.

5. A reanimation table according to claim 1, including means for locking said protective wall at a selected inclination above the horizontal position.

6. A reanimation table for a newborn infant comprising a receiving member having a top surface defining a substantially planar lying surface for receiving the infant, a base member mounted on said lying surface adjacent one end of said receiving member, a yoke member mounted on said base member and extending vertically upward therefrom, a radiation heater connected to said yoke member and extending outwardly over said lying surface, a protective wall pivotally mounted to said base member, said protective wall comprising two separate parts symmetrically mounted to said base member, each of said parts having a leg portion pivotally mounted to one of the ends of said base member and a web portion extending toward the other of said parts from an opposite end of said leg portion remote from said pivotally mounted end, each of said parts being separately pivotal between a first substantially horizontal position in engagement with said lying surface in which said leg portions and said web extending upright to form with said base member an enclosure for the infant over said lying surface and a second position in which said protective wall may extend substantially upright out of engagement with said lying surface.

* * * * *